US010246913B2

(12) United States Patent
Suzumura et al.

(10) Patent No.: US 10,246,913 B2
(45) Date of Patent: Apr. 2, 2019

(54) VEHICLE DOOR LOCK DEVICE

(71) Applicant: AISIN SEIKI KABUSHIKI KAISHA, Kariya-shi, Aichi-ken (JP)

(72) Inventors: Makoto Suzumura, Chita (JP); Kenji Okada, Anjo (JP); Sho Sannohe, Utsunomiya (JP); Kosuke Tsukamoto, Bangkok (TH); Yasuhiko Sono, Hekinan (JP); Takeshi Tada, Okazaki (JP); Eiji Torii, Aichi-ken (JP); Yoshiki Odaka, Obu (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 817 days.

(21) Appl. No.: 14/727,355

(22) Filed: Jun. 1, 2015

(65) Prior Publication Data

US 2015/0345191 A1 Dec. 3, 2015

(30) Foreign Application Priority Data

Jun. 3, 2014 (JP) ..... 2014-114890

(51) Int. Cl.
*E05B 85/24* (2014.01)
*E05B 81/16* (2014.01)
(Continued)

(52) U.S. Cl.
CPC ..... *E05B 85/243* (2013.01); *E05B 77/32* (2013.01); *E05B 79/22* (2013.01); *E05B 81/16* (2013.01); *Y10T 292/1076* (2015.04)

(58) Field of Classification Search
USPC ..... 292/201, 216
See application file for complete search history.

(56) References Cited

U.S. PATENT DOCUMENTS 8,403,379 B2 * 3/2013 Ishiguro ..... E05L 317/041 292/194
8,678,452 B2 * 3/2014 Nagaoka ..... E05B 77/265 292/201

(Continued)

FOREIGN PATENT DOCUMENTS

| | | |
|---|---|---|
| EP | 2 460 960 A1 | 6/2012 |
| FR | 2 815 988 A1 | 5/2002 |
| JP | 2011-026867 A | 2/2011 |

OTHER PUBLICATIONS

European Search Report dated Oct. 15, 2015, by the European Patent Office, in corresponding European Patent Application No. 15169892.7 (4 pages).

*Primary Examiner* — Carlos Lugo
(74) *Attorney, Agent, or Firm* — Buchanan Ingersoll & Rooney PC

(57) ABSTRACT

A vehicle door lock device includes: a latch mechanism configured to enable a vehicle door to maintain a closed state in a vehicle body; and a lock mechanism configured to set an unlocked state or a locked state, wherein the lock mechanism includes an inside opening lever connected to an inside door handle, and capable of being operated so as to be rotatable around a lever support portion between an initial position and a maximum operation position, an opening link capable of switching between a first position and a second position, a lock operation lever capable of being operated so as to be rotatable around the lever support portion between an unlocking position and a locking position, and a lever actuating mechanism actuating the inside opening lever toward the initial position.

2 Claims, 8 Drawing Sheets

(51) Int. Cl.
*E05B 79/22* (2014.01)
*E05B 77/32* (2014.01)

(56) References Cited

U.S. PATENT DOCUMENTS

| | | | | |
|---|---|---|---|---|
| 8,814,226 | B2 * | 8/2014 | Akizuki | E05L 377/30 292/196 |
| 8,919,827 | B2 * | 12/2014 | Akizuki | E05B 81/06 292/201 |
| 2002/0050156 | A1 | 5/2002 | Kobayashi et al. | |
| 2004/0119296 | A1 * | 6/2004 | Hayakawa | E05B 81/06 292/216 |
| 2004/0189016 | A1 * | 9/2004 | Fukunaga | E05B 81/06 292/201 |
| 2004/0262927 | A1 * | 12/2004 | Fukunaga | E05B 77/34 292/216 |
| 2005/0218662 | A1 * | 10/2005 | Umino | E05B 77/34 292/216 |
| 2011/0254287 | A1 | 10/2011 | Akizuki et al. | |
| 2012/0119520 | A1 | 5/2012 | Akizuki et al. | |

* cited by examiner

VEHICLE DOOR LOCK DEVICE

CROSS REFERENCE TO RELATED APPLICATIONS

This application is based on and claims priority under 35 U.S.C. § 119 to Japanese Patent Application 2014-114890, filed on Jun. 3, 2014, the entire contents of which are incorporated herein by reference.

TECHNICAL FIELD

This disclosure relates to a vehicle door lock device which is attached to a vehicle door.

BACKGROUND DISCUSSION

In the related art, vehicle door lock devices are known which include a lock mechanism for setting an unlocked state where a latch mechanism on a vehicle door side can disengage from a striker on a vehicle body side, or a locked state where the latch mechanism cannot disengage from the striker. For example, JP 2011-26867A (Reference 1) discloses one of the vehicle door lock devices. This door lock device has a lever drive mechanism mounted thereon. The lever drive mechanism utilizes a structure in which an inside opening lever drives a lock operation lever from a locking position to an unlocking position during a door opening operation of an inside door handle. According to this configuration, the lever drive mechanism differentiates between a drive start timing of an opening link using the inside opening lever (first timing) and a drive start timing of the lock operation lever using the inside opening lever (second timing).

The lever drive mechanism will be more specifically described. According to a mechanism in which the second timing is set to be delayed than the first timing, a so-called "double-pulling mechanism", the opening link is switched from the locking position to the unlocking position when the inside opening lever is rotatably operated from an initial position to a maximum operation position (also referred to as a "full position") by the first door opening operation of the inside door handle. Therefore, the vehicle door is not unlocked by the first door opening operation of the inside door handle. Thereafter, during a process while the inside opening lever is rotatably operated again from the initial position to the maximum operation position by the second door opening operation of the inside door handle, the opening link previously located at the unlocking position engages with a lift lever of the latch mechanism. Accordingly, the latch mechanism is switched from a latched state to an unlatched state so that the vehicle door is unlocked. On the other hand, according to a mechanism in which the second timing is set to be earlier than the first timing, a so-called "one-motion mechanism", when the inside door handle is used once for the door opening operation, an operation in which the opening link is switched from the locking position to the unlocking position and an operation in which the opening link engages with the lift lever of the latch mechanism are continuously performed so that the vehicle door is unlocked.

According to the door lock device having the above-described lever drive mechanism mounted thereon, in some cases, the lock operation lever is forcibly driven toward the locking position due to automatic lock control or manual control of the lock operation lever when the inside opening lever is located at the maximum operation position. This control can cause a possibility of the inside opening lever being prevented from properly returning to the initial position since the lock operation lever comes into contact with the inside opening lever. In this case, even after the inside door handle returns to the initial position by quitting the door opening operation, the inside opening lever cannot properly return to the initial position, and is kept at the maximum operation position. As a result, a flexible inside opening cable connected to the inside opening lever is bent, thereby causing a disadvantage that a cable end portion of the inside opening cable may drop out from an attachment hole of the inside opening lever or the cable end portion itself may buckle by being pressed against the inside opening lever.

SUMMARY

Thus, a need exists for an effective technique which is not suspectable to the drawback mentioned above.

A vehicle door lock device according to an aspect of this disclosure includes a latch mechanism and a lock mechanism. The latch mechanism is configured to enable a vehicle door to maintain a closed state in a vehicle body. The lock mechanism has a function of setting an unlocked state where the latch mechanism can disengage from a striker disposed in the vehicle body or a locked state where the latch mechanism cannot disengage from the striker.

The lock mechanism includes an inside opening lever, an opening link, a lock operation lever, and a lever actuating mechanism. The inside opening lever is connected to an inside door handle disposed on an inner side of the vehicle door via a flexible inside opening cable, and can be operated so as to be rotatable around a lever support portion between an initial position and a maximum operation position in response to door opening and closing operations of the inside door handle. The opening link can switch between a first position where an operation in a door opening direction of the inside opening lever in response to a door opening operation of the inside door handle is transferred to the latch mechanism and a second position where the operation in the door opening direction of the inside opening lever is not transferred to the latch mechanism. The lock operation lever can be operated so as to be rotatable around the lever support portion between an unlocking position for setting the opening link to be located at the first position and a locking position for setting the opening link to be located at the second position. The lock operation lever is pressed by the inside opening lever which is rotatably operated from the initial position to the maximum operation position due to the door opening operation of the inside door handle, and is driven from the locking position to the unlocking position.

The lever actuating mechanism has a function of actuating the inside opening lever toward the initial position by using a contact load which the inside opening lever receives from the lock operation lever, when the inside opening lever is located at a predetermined operation position where the inside opening lever comes into contact with the lock operation lever which is driven from the unlocking position to the locking position within a range from the initial position to the maximum operation position. The "predetermined operation position" described herein includes any desired operation position within a range from the initial position to the maximum operation position (operation position when the inside opening lever is rotatably operated to the maximum on a basis of the initial position). Therefore, the maximum operation position also corresponds to the "predetermined operation position" described herein.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
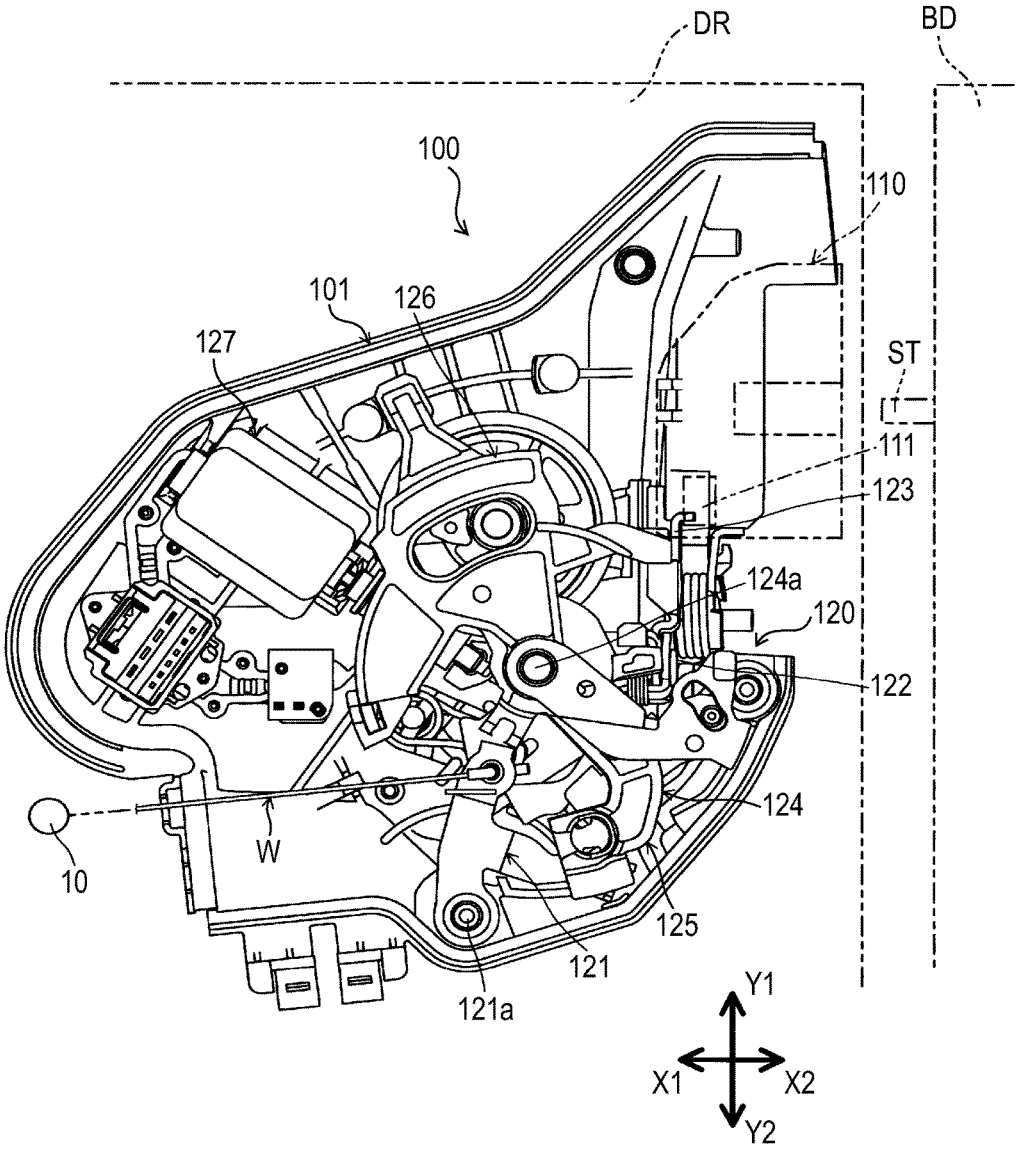
FIG. 1 is a view illustrating an internal structure of a vehicle door lock device according to an embodiment disclosed here.

Hereinafter, an embodiment of this disclosure will be described with reference to the drawings. In the drawings, a forward direction of a vehicle and a rearward direction of the vehicle are respectively illustrated by an arrow X1 and an arrow X2, and an upward direction of the vehicle and a downward direction with respect to the vehicle are respectively illustrated by an arrow Y1 and an arrow Y2. These directions can be applied to a vehicle door lock device in a state before being attached to a vehicle door, or a vehicle door lock device in a state after being attached to the vehicle door.

A vehicle door lock device (hereinafter, simply also referred to as a "door lock device") 100 according to this embodiment illustrated in FIG. 1 is mounted on a region defined by a door outer panel (vehicle exterior side panel) and a door inner panel (vehicle interior side panel) of a vehicle door DR. FIG. 1 illustrates a vehicle door on the right side of a vehicle as a representative example of the vehicle door DR.

The door lock device 100 includes a housing 101 for accommodating or assembling door lock configuration elements of the door lock device. The door lock configuration elements include a latch mechanism 110 and a lock mechanism 120.

As is known, the latch mechanism 110 is intended to maintain a state where the vehicle door DR is closed in a vehicle body BD. The latch mechanism 110 includes a latch (not illustrated) which can engage with and disengage from a striker ST fixed to the vehicle body BD, a pole (not illustrated) which can engage with and disengage from the latch and which can maintain and quit the engagement between the striker ST and the latch, and a lift lever 111 which is integrated with the pole. The latch engages with the striker ST and an engagement state therebetween is maintained, thereby maintaining a state where the vehicle door DR is closed (latched state). On the other hand, the latch disengages from the striker ST and the striker ST is released from the latch, thereby switching the vehicle door DR from a closed state to an open state (unlatched state). The latch mechanism 110 corresponds to a "latch mechanism" according to an aspect of this disclosure.

The lock mechanism 120 has a function of setting an unlocked state where the latch mechanism 110 can disengage from the striker ST disposed in the vehicle body BD, or a locked state where the latch mechanism cannot disengage from the striker ST. The lock mechanism 120 includes an inside opening lever 121, an outside opening lever 122, an opening link 123, a lock operation lever 124, and an electric motor 127. The lock mechanism 120 corresponds to a "lock mechanism" according to an aspect of this disclosure.

The inside opening lever 121 is connected to an inside door handle 10 which is a door operation handle disposed on an inner side of the vehicle door DR, via a flexible inside opening cable W. Therefore, a configuration is adopted in which the inside opening lever 121 is operated so as to be rotatable around a lever support portion (support shaft) 121*a* disposed in the housing 101 by a door opening operation of the inside door handle 10 from an initial position (position illustrated in FIG. 2) to a maximum operation position (position illustrated in FIG. 7 (also referred to as a "full position")) where the outside opening lever 122 and the opening link 123 are lifted up by a predetermined amount. In this case, the maximum operation position of the inside opening lever 121 is defined as an operation position when the inside opening lever 121 is rotatably operated to the maximum on a basis of the initial position. For this purpose, the inside opening lever 121 can engage with and disengage from the outside opening lever 122, and can engage with and disengage from the lock operation lever 124. The inside opening lever 121 corresponds to an "inside opening lever" according to an aspect of this disclosure.

The outside opening lever 122 is connected to an outside door handle (not illustrated) which is a door operation handle disposed on an outer side of the vehicle door DR. Therefore, a configuration is adopted in which the outside opening lever 122 is operated so as to be rotatable around a lever support portion (not illustrated) by a door opening operation of the outside door handle from an initial position to an operation position.

The opening link 123 is configured to be movable from an initial position to an operation position, when the inside opening lever 121 is rotatably operated from the initial position to the operation position, or when the outside opening lever 122 is rotatably operated from the initial position to the operation position. Furthermore, the opening link 123 is configured to be switched to an unlocked position (unlocked state) which is the initial position when the lock operation lever 124 moves from a locking position to an unlocking position, and to be switched to a locked position (locked state) which is the operation position when the lock operation lever 124 moves from the unlocking position to the locking position. That is, the opening link 123 is switched between the unlocked state and the locked state in response to a rotatable operation of the lock operation lever 124 between the unlocking position and the locking position.

When the opening link 123 is located at the unlocking position (first position) in a closed state of the vehicle door DR, an operation in a door opening direction of the respective opening levers 121 and 122 in response to a door opening operation of the respective door handles is transferred to the lift lever 111 which is a configuration element of the latch mechanism 110 via the opening link 123. That is, the lift lever 111 of the latch mechanism 110 is pressed by the opening link 123 and is rotatably operated, thereby switching the latch mechanism 110 from the latched state to the unlatched state. As a result, the vehicle door DR is unlocked. On the other hand, when the opening link 123 is located at the locking position (second position) in the closed state of the vehicle door DR, the operation in the door opening direction of the respective opening levers 121 and 122 in response to the door opening operation of the respective door handles is transferred to the opening link 123, but is not transferred from the opening link 123 to the lift lever 111 which is a configuration element of the latch mechanism 110. That is, the opening link 123 does not engage with the lift lever 111 of the latch mechanism 110, and the latch mechanism 110 maintains the latched state without any change. As a result, the vehicle door DR is not unlocked. The opening link 123 corresponds to an "opening link" according to an aspect of this disclosure.

The lock operation lever 124 can be operated so as to be rotatable around a lever support portion 124*a* disposed in the housing 101 between an unlocking position for setting the opening link 123 to be located at the unlocking position (first position) and a locking position for setting the opening link 123 to be located at the locking position (second position). The lock operation lever 124 is pressed against the inside opening lever 121 which is rotatably operated by the door opening operation of the inside door handle 10 from the initial position illustrated in FIG. 2 to the maximum operation position illustrated in FIGS. 7 and 8, and is driven from the locking position to the unlocking position. The lock operation lever 124 corresponds to a "lock operation lever" according to an aspect of this disclosure.

Figure 2:
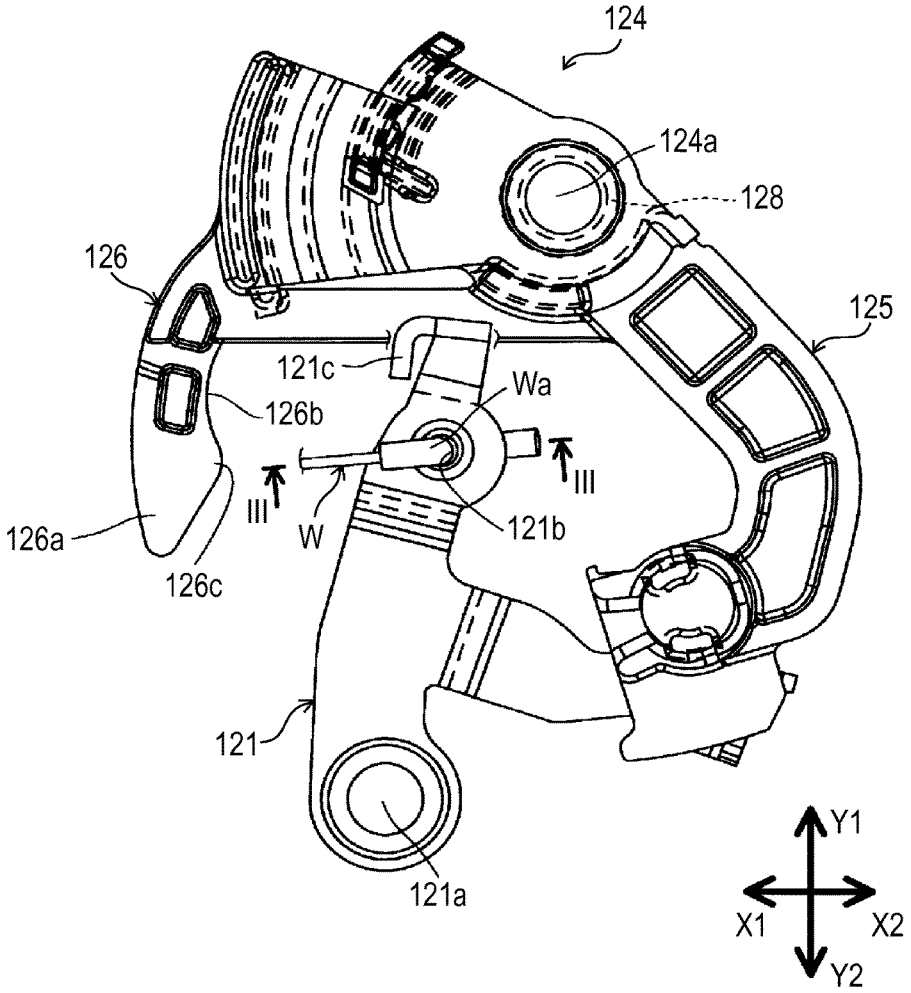
FIG. 2 is a view illustrating a structure of an inside opening lever and a lock operation lever within a lock mechanism in FIG. 1.

As illustrated in FIG. 2, the lock operation lever 124 includes a first lever portion (also referred to as an "inside locking lever") 125 and a second lever portion (also referred to as an "active lever") 126. A configuration is adopted in which the first lever portion 125 and the second lever portion 126 can be integrally operated so as to be rotatable around the common lever support portion 124*a*. The electric motor 127 is configured to function as an actuator for driving the lock operation lever 124. The second lever portion 126 of the lock operation lever 124 includes an engagement target portion 126*a* with which an engagement portion 121*c* disposed in the inside opening lever 121 can engage. The engagement target portion 126*a* includes a curved sliding surface 126*b* for engaging with the engagement portion 121*c* and a projecting portion 126*c* projecting toward the inside opening lever 121, in a region facing the inside opening lever 121. If necessary, the lock operation lever 124 can be configured to include one lever member in which a portion corresponding to the first lever portion 125 and a portion corresponding to the second lever portion 126 are integrated with each other.

Figure 3:
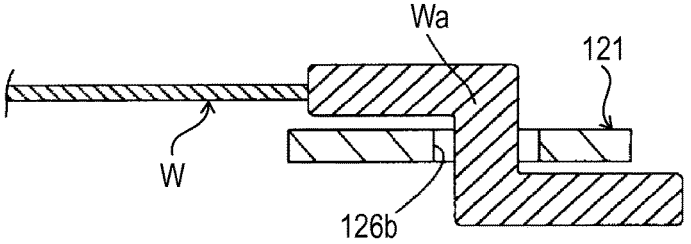
FIG. 3 is a view illustrating a cross-sectional structure of the inside opening lever, which is taken along line III-III in FIG. 2.
Figure 4:
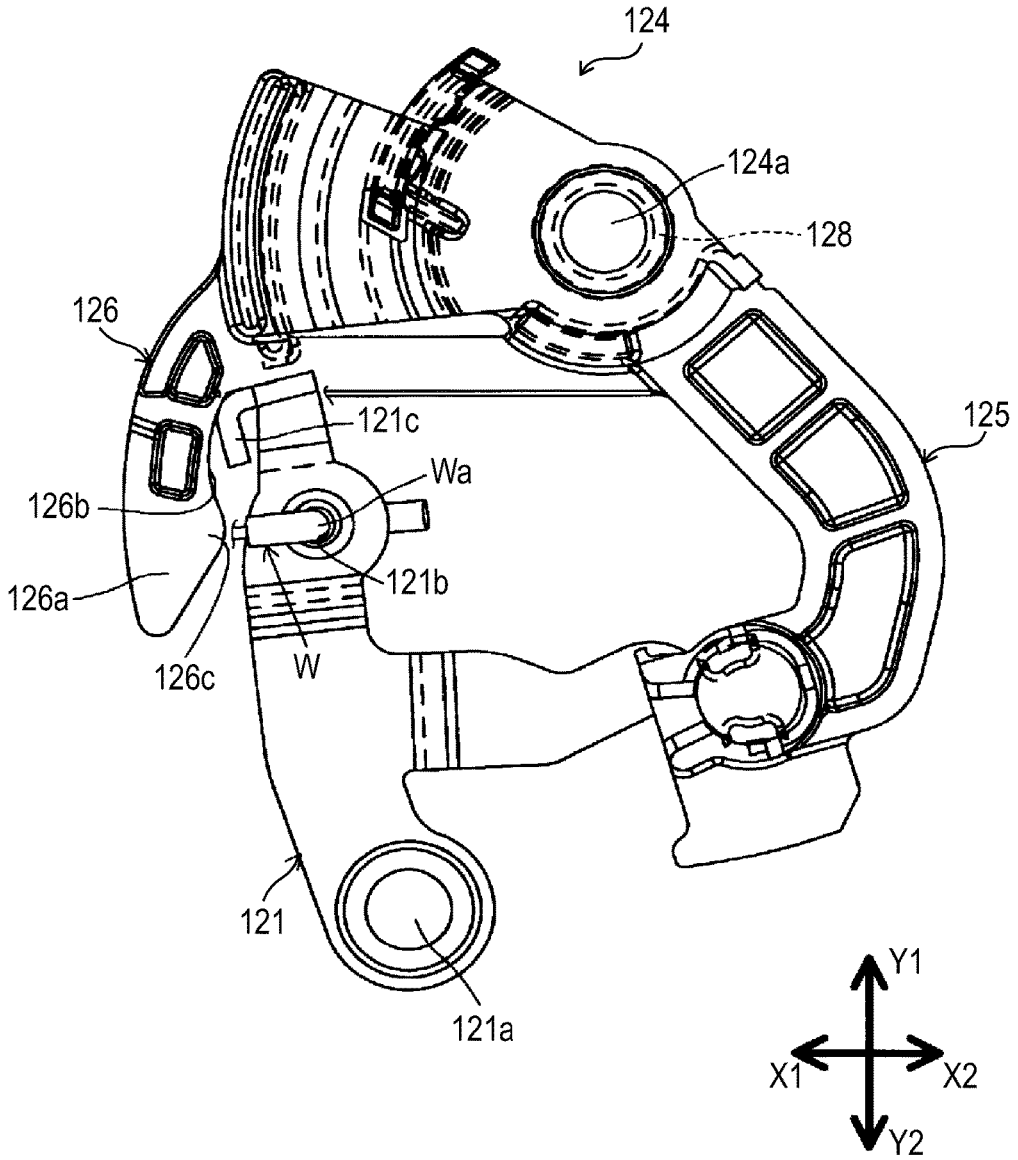
FIG. 4 is a view illustrating a state of the lock operation lever when the inside opening lever is rotatably operated counterclockwise from an initial position illustrated in FIG. 2 to a first operation position.

As illustrated in FIG. 3, the inside opening cable W includes a cable end portion Wa having a crank shape (step-like shape) in a cross-sectional view, and is connected to the inside opening lever 121 by inserting the cable end portion Wa into an attachment hole 121*b* of the inside opening lever 121.

For example, a more specific configuration of the latch mechanism 110 and the lock mechanism 120 can refer to a "latch mechanism", an "opening mechanism", and a "lock mechanism" which are disclosed in Reference 1.

The lock mechanism 120 having the above-described configuration has a lever drive mechanism, a so-called "double-pulling mechanism" mounted thereon. The lever drive mechanism utilizes a structure in which the inside opening lever 121 drives the lock operation lever 124 from the locking position to the unlocking position during the door opening operation of the inside door handle 10. In the lever drive mechanism, a drive start timing of the lock operation lever 124 using the inside opening lever 121 is set to be delayed than a drive start timing of the opening link 123 using the inside opening lever 121.

In a case of this double-pulling mechanism, the opening link 123 is switched from the locking position to the unlocking position when the inside opening lever 121 is rotatably operated from the initial position to the maximum operation position (also referred to as a "full position") by the first door opening operation of the inside door handle 10. Therefore, the vehicle door DR is not unlocked by the first door opening operation of the inside door handle 10. Thereafter, during a process while the inside opening lever 121 is rotatably operated again from the initial position to the maximum operation position by the second door opening operation of the inside door handle 10, the opening link 123 previously located at the unlocking position engages with the lift lever 111 of the latch mechanism 110. Accordingly, the latch mechanism 110 is switched from the latched state to the unlatched state so that the vehicle door DR is unlocked.

Hereinafter, referring to FIGS. 4 to 7, a manner will be described in detail in which the lock operation lever 124 having the above-described configuration is rotatably operated from the initial position illustrated in FIG. 2 to the maximum operation position in the lock mechanism 120 having the double-pulling mechanism mounted thereon.

During the door opening operation of the inside door handle 10 in FIG. 1, the inside opening lever 121 located at the initial position is rotatably operated counterclockwise around the lever support portion 121*a*. When the inside opening lever 121 is rotatably operated counterclockwise to reach a first operation position illustrated in FIG. 4, the engagement portion 121*c* of the inside opening lever 121 comes into contact with the sliding surface 126*b* facing the engagement portion 121*c* within the engagement target portion 126*a* of the second lever portion 126. In this case, the engagement portion 121*c* of the inside opening lever 121 which attempts to be rotatably operated further counterclockwise presses the sliding surface 126*b* while sliding thereon. In this manner, the lock operation lever 124 (the first lever portion 125 and the second lever portion 126) is rotatably operated clockwise around the lever support portion 124*a*.

Figure 5:
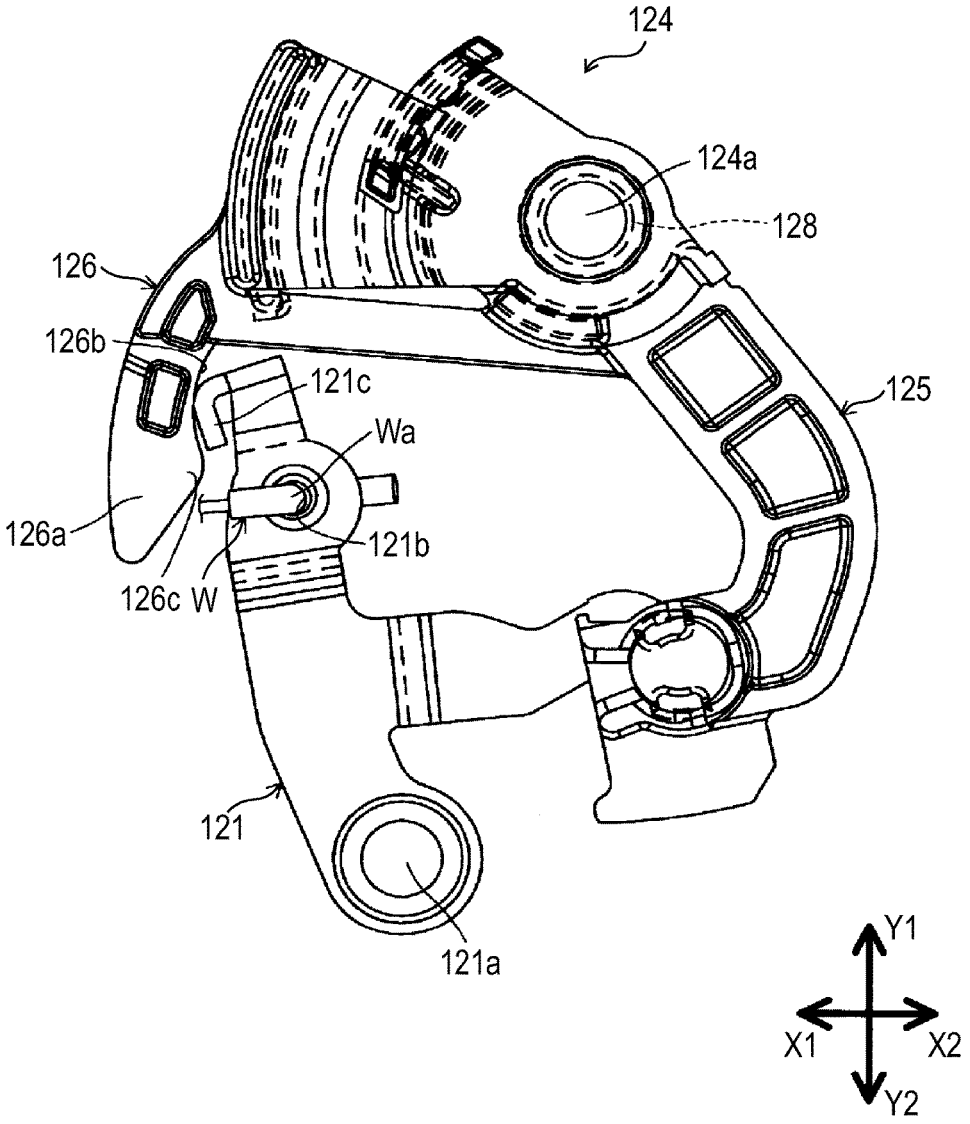
FIG. 5 is a view illustrating a state of the lock operation lever when the inside opening lever in FIG. 4 is further rotatably operated counterclockwise to a second operation position.
Figure 6:
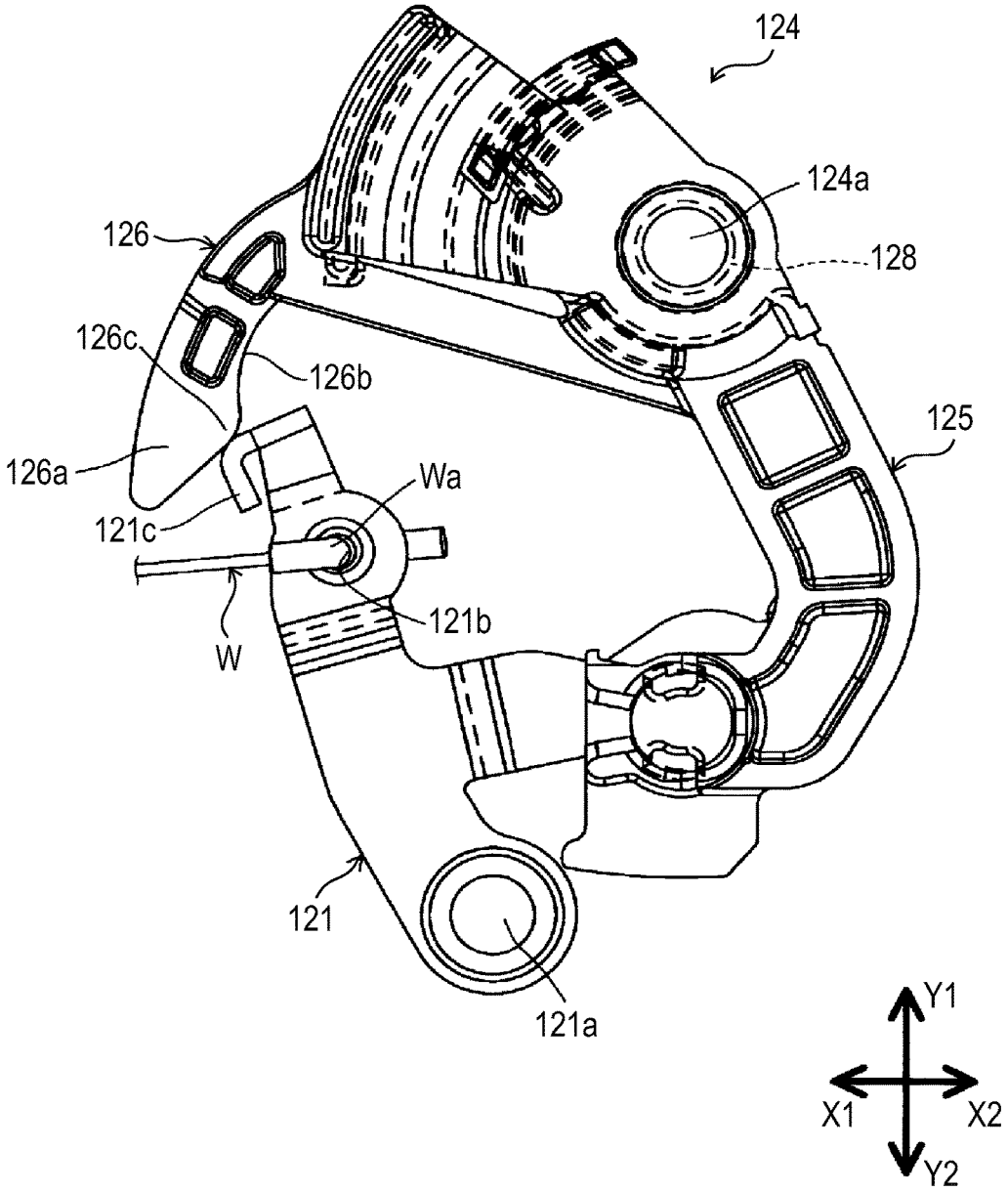
FIG. 6 is a view illustrating a state of the lock operation lever when the inside opening lever in FIG. 5 is further rotatably operated counterclockwise to a third operation position.

Thereafter, the inside opening lever 121 passes through a second operation position illustrated in FIG. 5, and is rotatably operated to reach a third operation position where the inside opening lever 121 crosses over the projecting portion 126*c* disposed on the sliding surface 126*b* of the engagement target portion 126*a* as illustrated in FIG. 6. At this time, the second lever portion 126 is hit by the engagement portion 121*c* of the inside opening lever 121 so as to be separated from the engagement portion 121*c*, and is further rotatably operated clockwise together with the first lever portion 125 by a torsion spring 128 which elastically actuates the second lever portion 126 clockwise. As a result, the inside opening lever 121 forms a clearance 129 between the engagement target portion 126*a* of the second lever portion 126 and the inside opening lever 121, in a state where the inside opening lever 121 is rotatably operated to reach the maximum operation position illustrated in FIG. 7.

Figure 7:
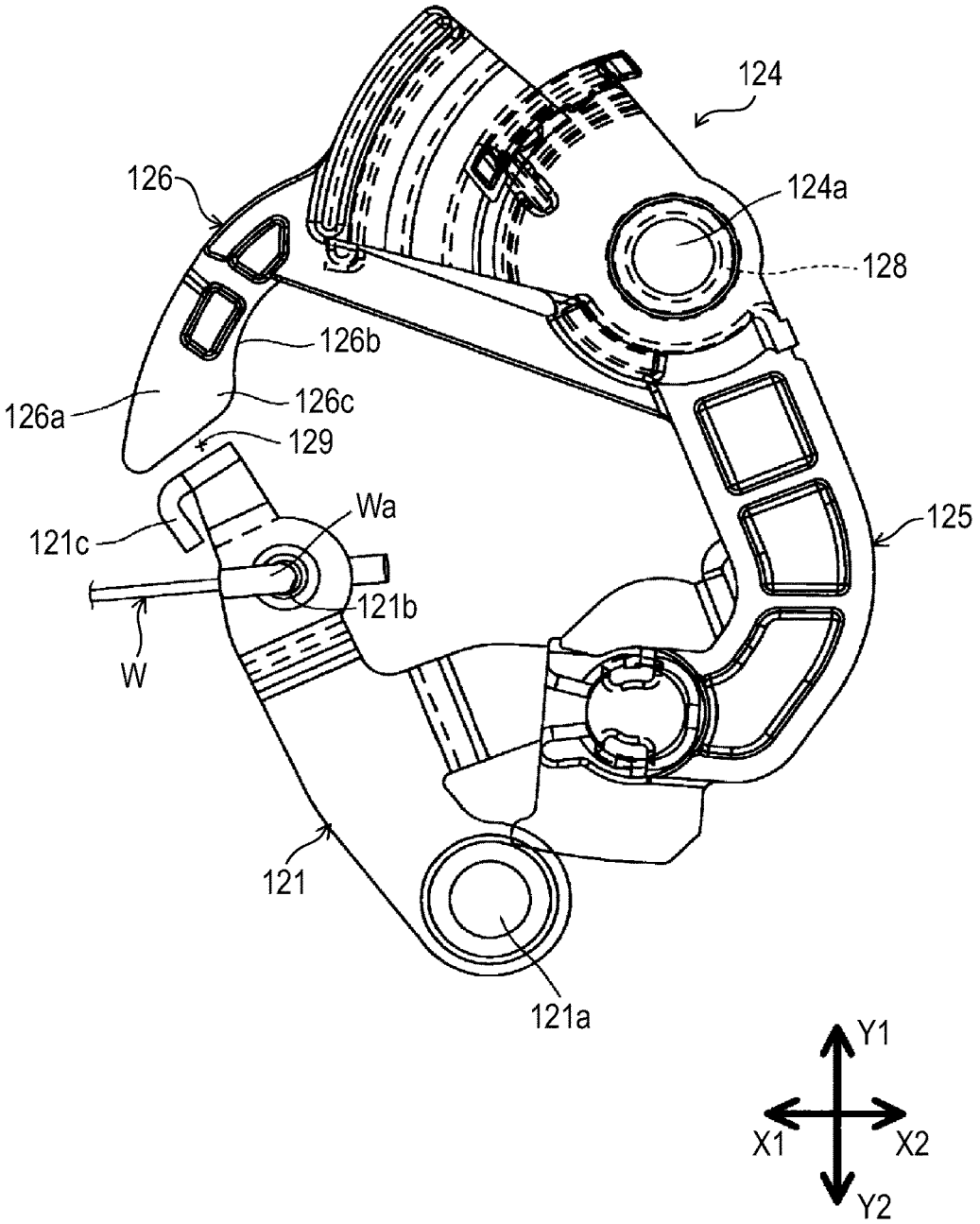
FIG. 7 is a view illustrating a state of the lock operation lever when the inside opening lever is rotatably operated to a final position.

Incidentally, in some cases, the lock operation lever 124 is forcibly driven counterclockwise toward the locking position due to automatic lock control or manual control of the lock operation lever 124 when the inside opening lever 121 is located at the maximum operation position illustrated in FIG. 7. Typically, this operation of the lock operation lever 124 can occur due to first control or second control described below. The first control is specified as the automatic lock control in which a vehicle speed sensor (not illustrated) detects that vehicle speed reaches a preset threshold value and thus the electric motor 127 serving as an actuator forcibly drives the lock operation lever 124 counterclockwise toward the locking position. The second control is specified as the manual control in which a vehicle occupant operates a manual switch in order to perform the lock operation of the lock operation lever 124 and thus the electric motor 127 forcibly drives the lock operation lever 124 counterclockwise toward the locking position.

Figure 8:
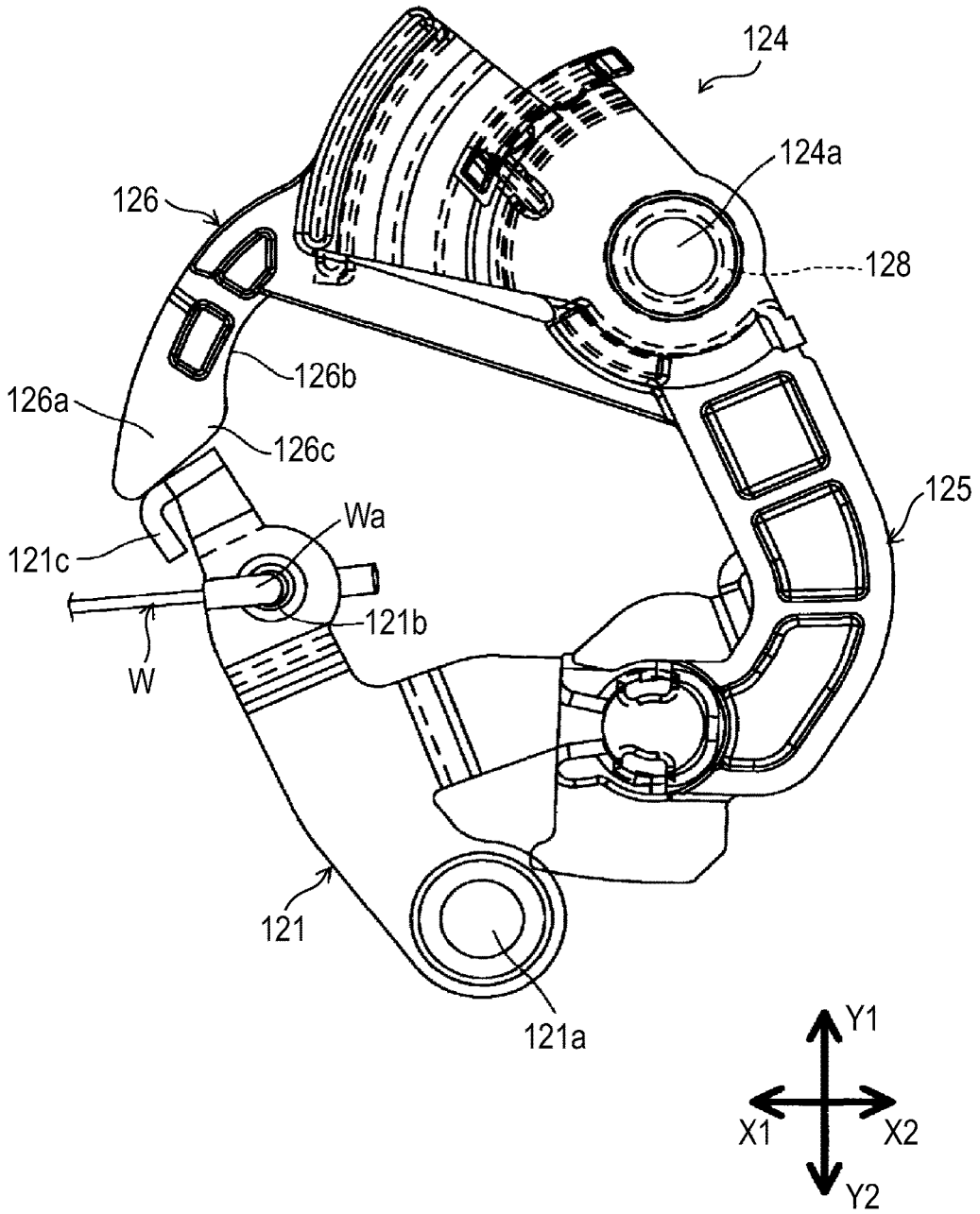
FIG. 8 is a view illustrating a state of the lock operation lever which is forcibly driven toward the locking position when the inside opening lever is located at the final position illustrated in FIG. 7.

In a case of the first control or the second control, as illustrated in FIG. 8, the second lever portion 126 comes into contact with the engagement portion 121*c* of the inside opening lever 121. At this time, if the inside opening lever 121 receives a load from the second lever portion 126 so that the inside opening lever 121 is kept at the maximum operation position or receives a load from the second lever portion 126 so that the inside opening lever 121 is actuated counterclockwise, the inside opening lever 121 cannot properly return to the initial position even after returning to the initial position by quitting the door opening operation of the inside door handle 10, and is kept at the maximum operation position. As a result, the flexible inside opening cable W connected to the inside opening lever 121 is bent, thereby causing a disadvantage that the cable end portion Wa of the inside opening cable W drops out from the attachment hole 121*b* of the inside opening lever 121 or the cable end portion Wa itself buckles by being pressed against the inside opening lever 121.

Figure 9:
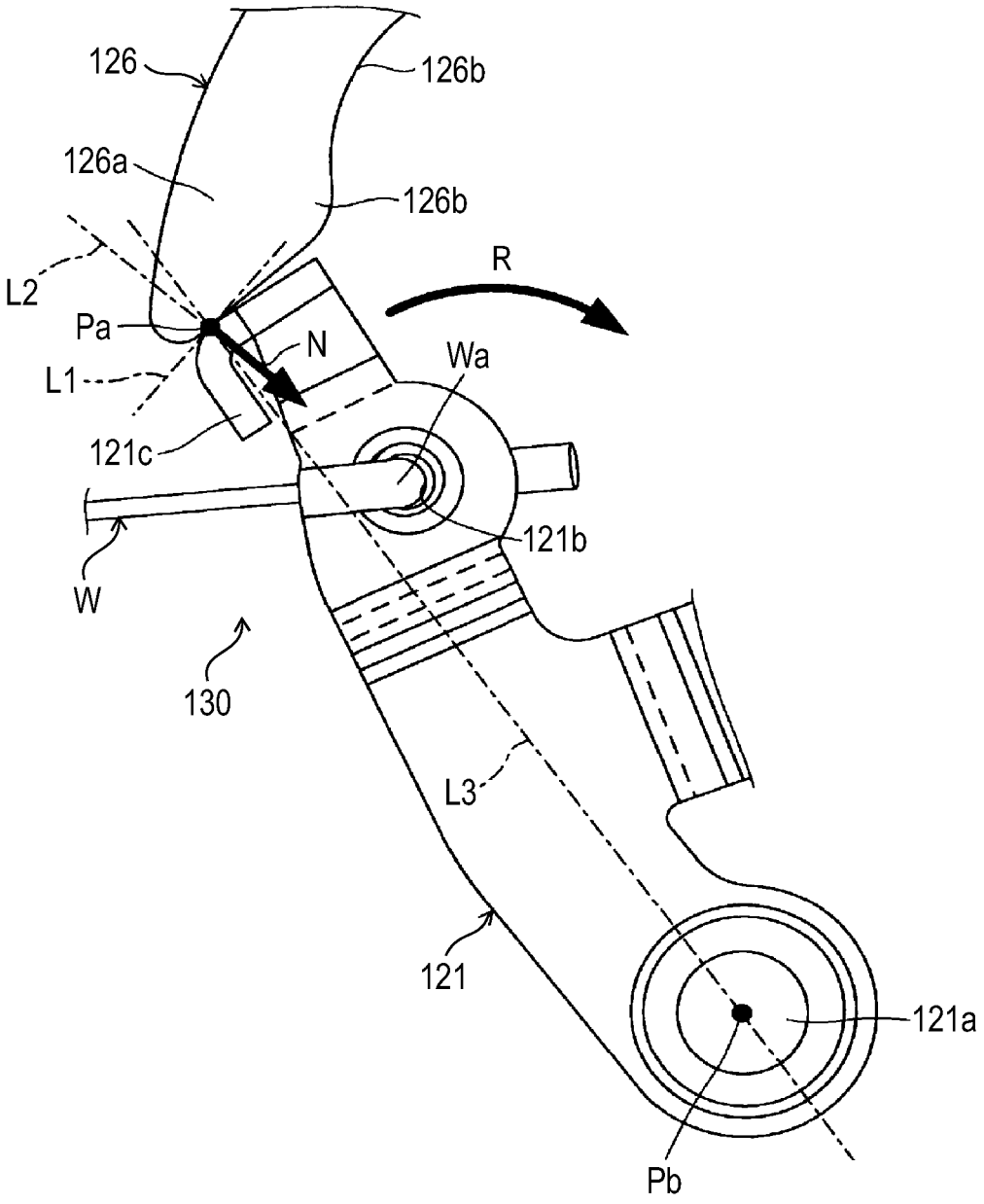
FIG. 9 is a partially enlarged view of FIG. 8, and is a view for illustrating an operation of a lever actuating mechanism allocated to the lock mechanism.

Therefore, according to the embodiment disclosed here, as illustrated in FIG. 9, a lever actuating mechanism 130 is allocated to the lock mechanism 120. When the inside opening lever 121 is located at the maximum operation position where the inside opening lever 121 comes into contact with the lock operation lever 124 which is driven from the unlocking position to the locking position, the lever actuating mechanism 130 has a function of actuating the inside opening lever 121 toward the initial position by using a contact load which the inside opening lever 121 receives from the lock operation lever 124. The lever actuating mechanism 130 corresponds to a "lever actuating mechanism" according to an aspect of this disclosure.

According to this lever actuating mechanism 130, it is possible to avoid a case where the inside opening lever 121 is blocked by the lock operation lever 124 at the maximum operation position. Thus, the inside opening lever 121 is rotatably operated around the lever support portion 121*a* in a direction of an arrow R in FIG. 9, and can return to the initial position. In this case, when the inside door handle 10 returns to the initial position by quitting the door opening operation, the inside opening lever 121 also properly returns to the initial position. Therefore, a proper operation of the inside opening lever 121 is allowed when the lock operation lever 124 is forcibly driven toward the locking position. At this time, a state is maintained where proper tension is applied to the flexible inside opening cable W. As a result, it is possible to prevent the inside opening cable W from being bent. Accordingly, it is possible to prevent a disadvantage that the cable end portion Wa of the inside opening cable W drops out from the attachment hole 121*b* of the inside opening lever 121 or the cable end portion Wa itself buckles by being pressed against the inside opening lever 121.

In particular, the lever actuating mechanism 130 is configured by using a structure of the inside opening lever 121 and the lock operation lever 124. To be more specific, in the lever actuating mechanism 130, the inside opening lever 121 and the lock operation lever 124 have a configuration in which a direction vector of the contact load received by the inside opening lever 121 at the maximum operation position is a normal vector N intersecting a connecting line L3 which connects the lever support portion 121*a* (rotation center point Pb) of the inside opening lever 121 and a contact point Pa so as to actuate the inside opening lever 121 toward the initial position on a normal line L2 at the contact point Pa between the inside opening lever 121 and the lock operation lever 124. Typically, it is possible to determine, for example, relative geometric shapes, relative dimensions, and relative arrangements of the inside opening lever 121 and the lock operation lever 124 so that a desired normal vector N can be obtained as the direction vector of the contact load received by the inside opening lever 121 from the lock operation lever 124 at the maximum operation position. In this manner, the inside opening lever 121 can reliably return to the initial position by using the normal vector N at the contact point Pa between the inside opening lever 121 and the lock operation lever 124. In addition, the lever actuating mechanism 130 is built by using the inside opening lever 121 and the lock operation lever 124 which are existing configuration elements of the lock mechanism 120. Accordingly, it is possible to realize the inexpensive door lock device 100 without increasing the number of components.

Without being limited to the above-described representative embodiment, it is conceivable that this disclosure can be applied or modified in various ways. For example, the following forms can also be embodied by applying the above-described embodiment.

In the above-described embodiment, a double-pulling mechanism has been described which is one of mechanisms for differentiating between a drive start timing of the opening link 123 using the inside opening lever 121 and a drive start timing of the lock operation lever 124 using the inside opening lever 121. However, this disclosure can employ a so-called "one-motion mechanism" instead of the double-pulling mechanism. According to the one-motion mechanism, when the inside door handle 10 is used once for the door opening operation, an operation in which the opening link 123 is switched from the locking position to the unlocking position and an operation in which the opening link 123 engages with the lift lever 111 of the latch mechanism 110 are continuously performed so that the vehicle door DR is unlocked. Similarly to a case of the double-pulling mechanism, even in a case of the one-motion mechanism, a situation can occur in which the operation of the inside opening lever 121 for returning to the initial position is blocked by the lock operation lever 124. Therefore, this disclosure can also be similarly applied to the lock mechanism having the one-motion mechanism mounted thereon.

In the above-described embodiment, the lever actuating mechanism 130 has been described which has a function of avoiding a case where the operation of the inside opening lever 121 for returning to the initial position is blocked by the lock operation lever 124 when the inside opening lever 121 is located at the maximum operation position. However, according to an aspect of this disclosure, a target position of the inside opening lever 121 provided with a function of the lever actuating mechanism 130 is not limited to the maximum operation position. As the target position, it is possible to appropriately select any desired operation position within a range from the initial position to the maximum operation position of the inside opening lever 121.

According to an aspect of this disclosure, an essential structure of the above-described door lock device 100 can be applied to each vehicle door of a vehicle. For example, the essential structure of the door lock device 100 according to an aspect of this disclosure can be applied to right and left doors for vehicle front seats, can be applied to right and left doors for vehicle rear seats, and can be further applied to a vehicle rear side door (rear door).

A vehicle door lock device according to an aspect of this disclosure includes a latch mechanism and a lock mechanism. The latch mechanism is configured to enable a vehicle door to maintain a closed state in a vehicle body. The lock mechanism has a function of setting an unlocked state where the latch mechanism can disengage from a striker disposed in the vehicle body or a locked state where the latch mechanism cannot disengage from the striker.

The lock mechanism includes an inside opening lever, an opening link, a lock operation lever, and a lever actuating mechanism. The inside opening lever is connected to an inside door handle disposed on an inner side of the vehicle door via a flexible inside opening cable, and can be operated so as to be rotatable around a lever support portion between an initial position and a maximum operation position in response to door opening and closing operations of the inside door handle. The opening link can switch between a first position where an operation in a door opening direction of the inside opening lever in response to a door opening operation of the inside door handle is transferred to the latch mechanism and a second position where the operation in the door opening direction of the inside opening lever is not transferred to the latch mechanism. The lock operation lever can be operated so as to be rotatable around the lever support portion between an unlocking position for setting the opening link to be located at the first position and a locking position for setting the opening link to be located at the second position. The lock operation lever is pressed by the inside opening lever which is rotatably operated from the initial position to the maximum operation position due to the door opening operation of the inside door handle, and is driven from the locking position to the unlocking position.

The lever actuating mechanism has a function of actuating the inside opening lever toward the initial position by using a contact load which the inside opening lever receives from the lock operation lever, when the inside opening lever is located at a predetermined operation position where the inside opening lever comes into contact with the lock operation lever which is driven from the unlocking position to the locking position within a range from the initial position to the maximum operation position. The "predetermined operation position" described herein includes any desired operation position within a range from the initial position to the maximum operation position (operation position when the inside opening lever is rotatably operated to the maximum on a basis of the initial position). Therefore, the maximum operation position also corresponds to the "predetermined operation position" described herein.

According to this lever actuating mechanism, it is possible to avoid a case where the inside opening lever is blocked by the lock operation lever at the predetermined operation position. Thus, the inside opening lever can return to the initial position. In this case, when the inside door handle returns to the initial position by quitting the door opening operation, the inside opening lever also properly returns to the initial position. Therefore, a proper operation of the inside opening lever is allowed when the lock operation lever is forcibly driven toward the locking position. At this time, a state is maintained where proper tension is applied to the flexible inside opening cable. As a result, it is possible to prevent the inside opening cable from being bent. Accordingly, it is possible to prevent a disadvantage that a cable end portion of the inside opening cable drops out from an attachment hole of the inside opening lever or the cable end portion itself buckles by being pressed against the inside opening lever.

In the lever actuating mechanism having the configuration described above, it is preferable that the inside opening lever and the lock operation lever have a configuration in which a direction vector of the contact load received by the inside opening lever at the predetermined operation position is a normal vector intersecting a connecting line which connects the lever support portion of the inside opening lever and a contact point so as to actuate the inside opening lever toward the initial position on a normal line at the contact point between the inside opening lever and the lock operation lever. Typically, it is possible to determine, for example, relative geometric shapes, relative dimensions, and relative arrangements of the inside opening lever and the lock operation lever so that a desired normal vector can be obtained as the direction vector of the contact load received by the inside opening lever at the predetermined operation position. In this manner, the inside opening lever can reliably return to the initial position by using the normal vector at the contact point between the inside opening lever and the lock operation lever. In addition, the lever actuating mechanism is built by using the inside opening lever and the lock operation lever which are existing configuration elements of the lock mechanism. Accordingly, it is possible to realize an inexpensive door lock device without increasing the number of components.

As described above, according to the aspect of this disclosure, there is provided a vehicle door lock device including a lever drive mechanism in which an inside opening lever drives a lock operation lever from a locking position to an unlocking position during a door opening operation of an inside door handle. The vehicle door lock device enables a proper operation of the inside opening lever when the lock operation lever is forcibly driven toward the locking position.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock device comprising:

a latch mechanism configured to enable a vehicle door to maintain a closed state in a vehicle body; and a lock mechanism configured to set an unlocked state where the latch mechanism can disengage from a striker disposed in the vehicle body or a locked state where the latch mechanism cannot disengage from the striker, wherein the lock mechanism includes an inside opening lever that is connected to an inside door handle disposed on an inner side of the vehicle door via a flexible inside opening cable, and that can be operated so as to be rotatable around an inside opening lever support portion between an initial position and a maximum operation position in response to door opening and closing operations of the inside door handle, an opening link that can switch between a first position where an operation in a door opening direction of the inside opening lever in response to a door opening operation of the inside door handle is transferred to the latch mechanism and a second position where the operation in the door opening direction of the inside opening lever is not transferred to the latch mechanism, a lock operation lever that can be operated so as to be rotatable around a lock operation lever support portion between an unlocking position for setting the opening link to be located at the first position and a locking position for setting the opening link to be located at the second position, and that is pressed by the inside opening lever, which is rotatably operated from the initial position to the maximum operation position due to the door opening operation of the inside door handle, to drive the lock operation lever from the locking position toward the unlocking position, and wherein the inside opening lever and the lock operation lever have a configuration in which, when the inside opening lever is located at a predetermined operation position with a gap between the inside opening lever and the lock operation lever after the inside opening lever has moved to the maximum operation position while in contact with the lock operation lever, the predetermined opening position being located at any position within a range which includes the maximum operation position, and the lock operation lever is forcibly driven toward the inside opening lever, the lock operation lever imparts a contact load to the inside opening lever which moves the inside opening lever toward the initial position.

2. The vehicle door lock device according to claim 1, wherein the inside opening lever and the lock operation lever have a configuration in which a direction vector of the contact load received by the inside opening lever at the predetermined operation position is a normal vector intersecting a connecting line which connects the inside opening lever support portion and a contact point so as to actuate the inside opening lever toward the initial position on a normal line at the contact point between the inside opening lever and the lock operation lever.

* * * * *